United States Patent [19]

Purcell

[11] 4,445,411

[45] May 1, 1984

[54] END DOGGING LOG FEEDER

[75] Inventor: Bill L. Purcell, Eureka, Mont.

[73] Assignee: Hoff Companies, Inc., Boise, Id.

[21] Appl. No.: 350,438

[22] Filed: Feb. 22, 1982

[51] Int. Cl.[3] ..... B27B 15/08; B27B 25/04

[52] U.S. Cl. ..... 83/403.1; 83/409; 83/423; 83/425.2; 83/435.2; 198/748

[58] Field of Search ..... 83/435.2, 707–712, 83/731, 425.2, 409, 423, 403.1; 144/376–378; 198/748, 620, 621, 626, 627

[56] References Cited

U.S. PATENT DOCUMENTS

| | | | |
|---|---|---|---|
| 936,314 | 10/1909 | Dittbenner | 83/435.2 |
| 2,332,654 | 10/1943 | Mead et al. | 144/242 R |
| 2,964,074 | 12/1960 | Brown | 83/435.2 X |
| 3,875,841 | 4/1975 | Noble | 83/708 |
| 4,009,632 | 3/1977 | Detjen | 83/731 |
| 4,152,960 | 5/1979 | Detjen | 83/435.2 |
| 4,271,736 | 6/1981 | Jones | 83/425.2 X |
| 4,398,629 | 8/1983 | Williamson | 198/748 |

*Primary Examiner*—James M. Meister

[57] ABSTRACT

A single narrow track frame having guideways for a push chain and a holdback chain extends between a pair of vertical saws for cutting slabs or boards off opposite sides of a log or cant. The track frame is under the log. The push chain has upstanding push dogs and the holdback chain has upstanding holdback dogs to grip the ends of the logs, all the dogs being formed as links in the chains.

6 Claims, 14 Drawing Figures

FIG. 8
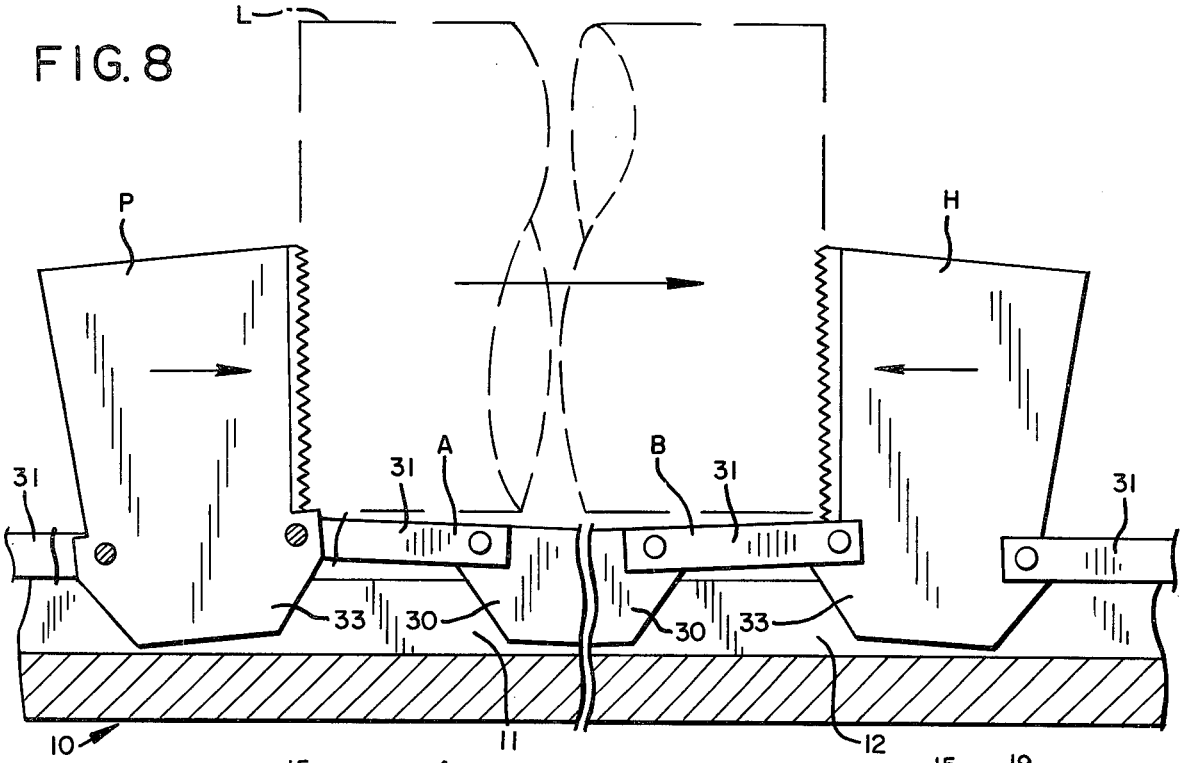
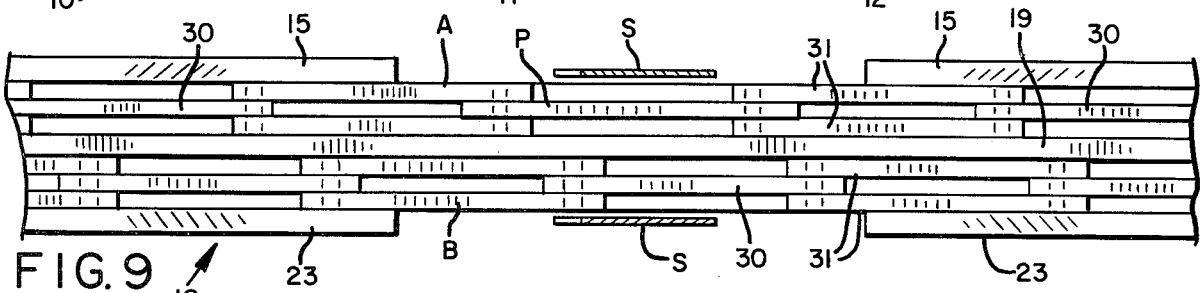
FIG. 9
FIG. 10
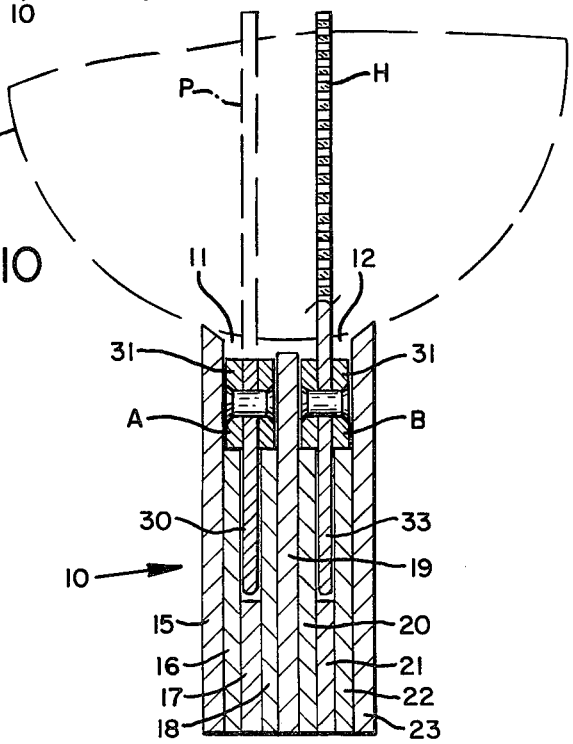
FIG. 11
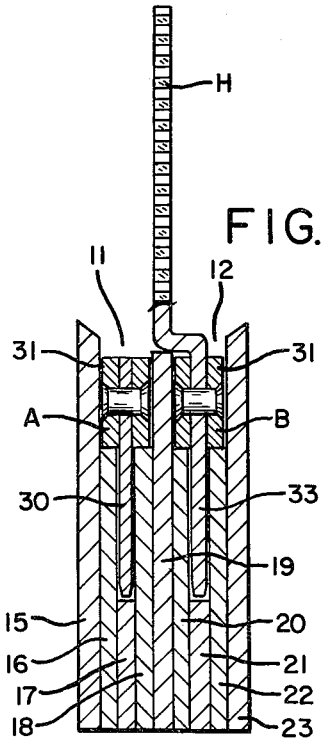

END DOGGING LOG FEEDER

BACKGROUND OF THE INVENTION

This invention relates to an end dogging log feeder to move a log or cant lengthwise in a horizontal path through a pair of vertical saws to cut slabs or boards off opposite sides of the log or cant.

In this mode of operation the log is firmly gripped lengthwise betwwen a push dog engaging the trailing end of the log and a holdback dog engaging the leading end of the log, both of said dogs passing between the saws. Sawmill apparatus heretofore proposed for this mode of operation has been very complicated and expensive to install and maintain.

It has been proposed, for example, to move one of the dogs by an endless chain or carrier under the log and to mount the other dog on an endless chain or carrier above the log. This not only requires considerable duplication of machinery but also requires a complicated vertical adjustment of the upper dog carrier to accommodate logs of different diameters. If large and small logs are intermixed in the infeed, such vertical adjustment must be made for almost every log coming into the sawmill.

It has also been proposed to mount both dogs on carriers above the logs. This arrangement also requires similar vertical adjustment and further complicates the apparatus because the carriers for the dogs cannot be made narrow enough to pass between the saws.

SUMMARY OF THE INVENTION

The present arrangement is much less complicated and expensive, having fewer moving parts to manufacture and maintain and requiring no adjustment for logs of different sizes.

This is accomplished by providing a single narrow track frame under the log and extending between the saws. This single track frame contains a pair of guideways in side by side relation with an endless chain for push dogs traveling in one guideway and an endless chain for holdback dogs traveling in the other guideway. This arrangement permits a relatively simple drive mechanism for the two chains and does not require any vertical adjustment for logs of different sizes. Since the number of moving parts is greatly reduced, the original costs and maintenance are likewise reduced.

The log or cant may be reciprocated for repeated cuts by the same saws if desired and the saws may be adjusted closely enough together on opposite sides of the track frame to produce a relatively narrow center heart piece when desired, without requiring a second set of saws.

The invention will be better understood and additional objects and advantages will become apparent from the following description of the preferred embodiments illustrated in the accompanying drawings. Various changes made be made in the details of construction and arrangement of parts and certain features may be used without others. All such modifications within the scope of the appended claims are included in the invention.

BRIEF DESCRIPTION OF THE DRAWINGS

FIG. 8 is a fragmentary side elevation view with parts broken away showing how a log is gripped at its ends between a push dog and a holdback dog.

FIG. 9 is a top plan view with parts in section showing a portion of the track frame between the saws.

FIG. 10 is a vertical cross-section view of the track frame and dog chains.

FIG. 11 is a view similar to FIG. 10 showing a modified shape of dog.

FIG. 2 is an end elevation view with parts in section showing the infeed end of the apparatus.

DESCRIPTION OF THE PREFERRED EMBODIMENTS

Figure 1:
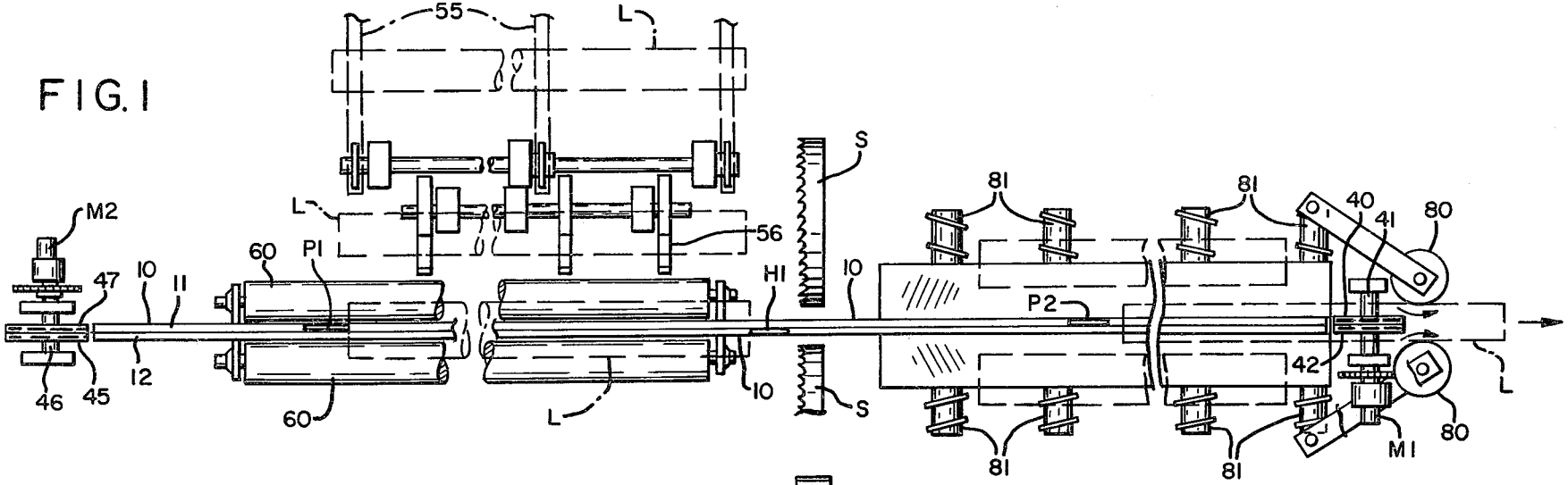
FIG. 1 is a top plan view with parts broken away showing a sawmill apparatus embodying the invention.
Figure 2:
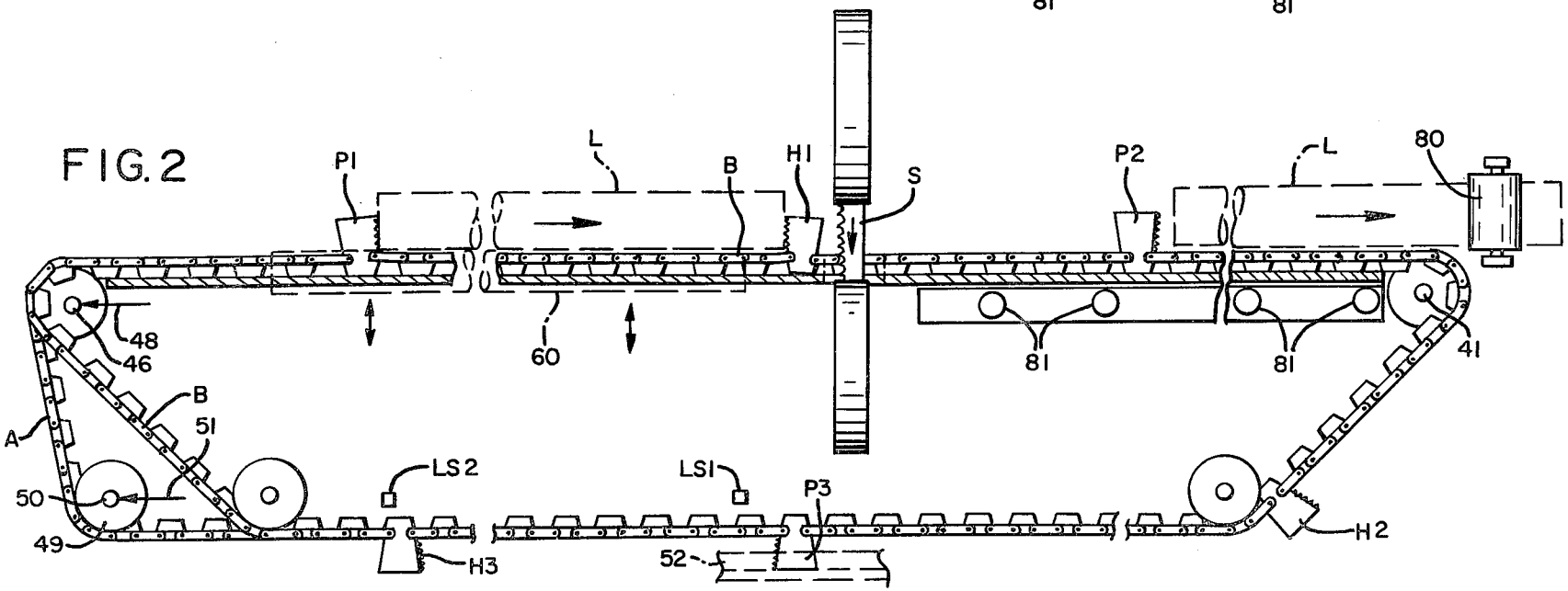
FIG. 2 is a side elevation view with parts broken away.

Referring first to FIGS. 1 and 2, a single horizontal track frame 10 extends between the two vertical bandsaws S,S. The upper side of track frame 10 has a guideway 11 for a push chain A alongside a guideway 12 for a holdback chain B. Push chain A has three push dogs P1, P2 and P3 equally spaced apart and holdback chain B has three holdback dogs H1,H2 and H3 equally spaced apart.

As shown in FIG. 10 track frame 10 is a lamination of a plurality of flat metal plates 15–23 secured together by suitable means such as welding, rivets or bolts. Plate 19 is median plate separating the push chain guideway 11 from the holdback chain guideway 12. Plates 15 and 23 are outside plates. Plates 17 and 21 are spacer plates and plates 14, 18, 20 and 22 are chain support plates.

Thus the track frame 10 is very narrow, not significantly aimiting the minimum spacing of saws S,S in order to provide adequate clearance between the saws and track frame. Preferably, the outside plates 15 and 23 are interrupted in the immediate vicinity of saws, S,S to still further reduce the possible minimum spacing of the saws as shown in FIG. 9.

Figure 7:
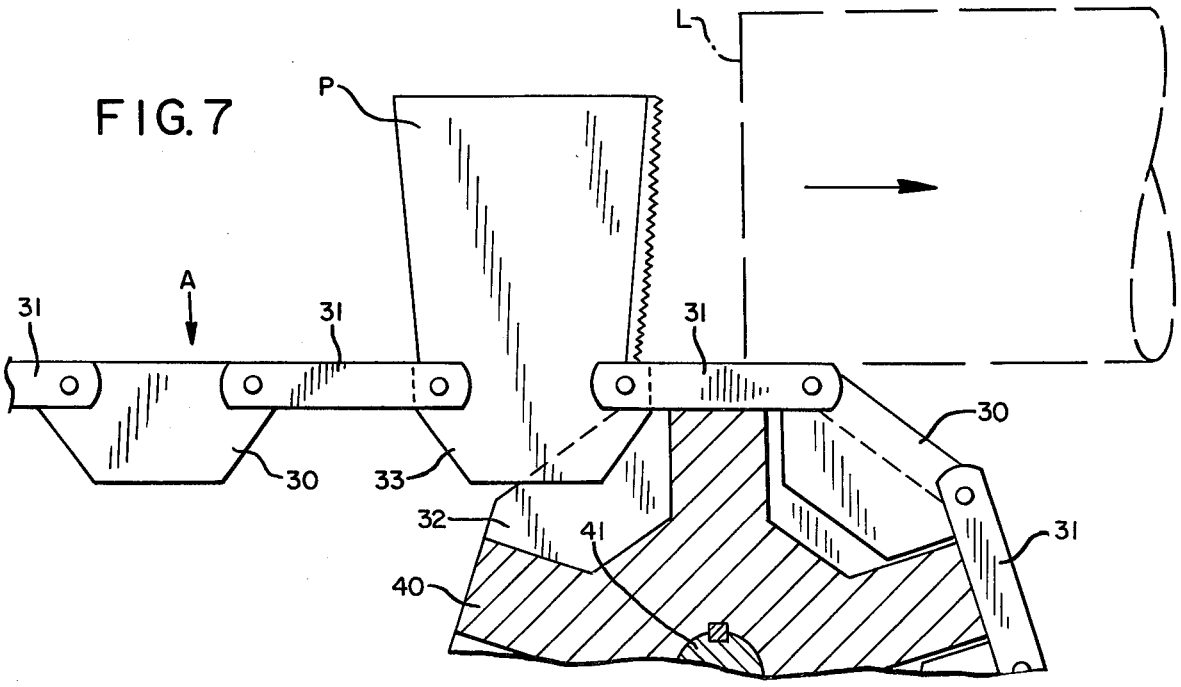
FIG. 7 is an enlarged fragmentary view with parts in section showing a drive sprocket and push dog chain.

As shown in FIGS. 7–10, push chain A comprises the three push dogs P and a plurality of drive lugs 30 pivotally connected between pairs of outside links 31. Eash push dog P has a downward extension 33 forming a drive lug indentical to drive lugs 30. These drive lugs engage sockets 32 in several sprocket wheels which support and drive the chain as shown in FIG. 7. Holdback chain B is of identical construction except that holdback dogs H are reversed with respect to push dogs P. Thus the dogs P and H are flat plates.

FIG. 11 shows a modification in which the dogs H are offset to the left at 35 to place these dogs in the vertical plane of median plate 19. Push dogs P are similarly offset to the right whereby all the dogs P and H travel in a common vertical plane.

Referring back to FIGS. 1 and 2, push chain A is driven by sprocket wheel 40 which is keyed to a shaft 41 driven by a reversible variable speed hydraulic motor and reduction gear unit M1. Chain B passes around an idler sprocket wheel 42 mounted on a bearing on shaft 41. These sprocket wheels are at the outfeed end of track frame 10.

At the infeed end of track frame 10, chain B is driven by a sprocket wheel 45 keyed to a shaft 46 driven by a reversible variable speed hydraulic motor and reduction gear unit M2. Chain A passes around an idler sprocket wheel 47 mounted on a bearing on shaft 46.

Shaft 46 is adjustable as indicated by arrow 48 to tighten or loosen both chains A and B. Chain A passes around sprocket wheel 49 on shaft 50 which is adjustable as indicated by arrow 51 to tighten or loosen chain A individually. The return flights of the chains are supported by a track frame 52.

Figure 12:
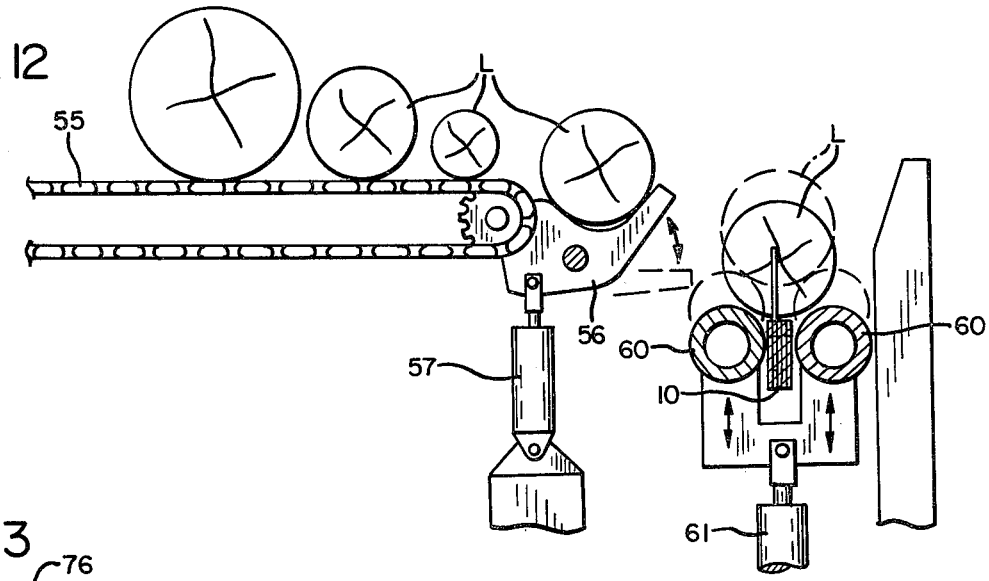

Referring now to FIGS. 1 and 12, log deck chains 55 at the infeed end of the system hold a plurality of logs L of different diameter. These logs are advanced one after another to pivotal cradle 56 which may be tilted by hydraulic cylinder 57.

On opposite sides of track frame 10 is pair of power driven turning rolls 60 which may be raised to broken line position above the track frame by hydraulic cylinder 61. The tilting of cradle 56 to its broken line position allows the log in the cradle to roll onto the turning rolls 60 which are then rotated under the control of the operator to rotate the log into the desired position for sawing by the saws S,S. The turning rolls 60 are then lowered to bring the log to rest on track frame 10.

Figure 3:
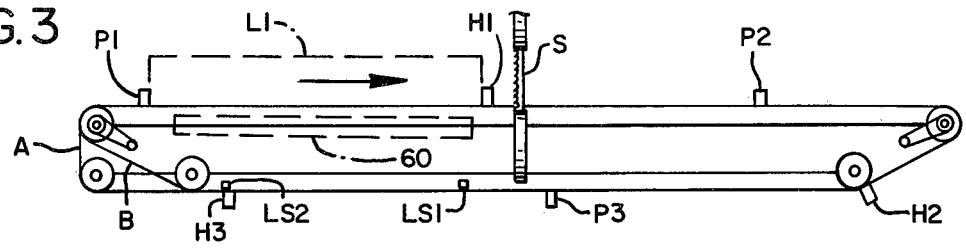
FIGS. 3–6 are a sequence of schematic views showing the operation of sawing a log.
Figure 4:
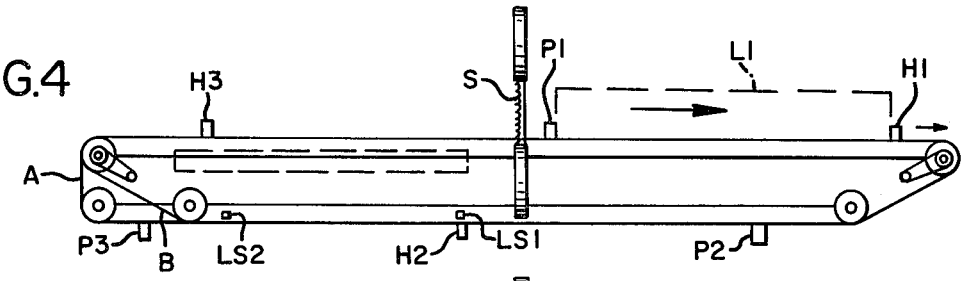

The next sequence of operations is illustrated in FIGS. 3–6. At the conclusion of the last previous sawing operation dog H3 has actuated limit switch LS2 to stop the advance of holdback dog H1 just ahead of the saws S,S as shown in FIG. 3. Log L1 rests on track frame 10 immediately behind holdback dog H1, the saws are running and set to lateral positions to make the desired cuts. Push dog P1 is advanced to engage the trailing end of log L1 and grip the log securely against dog H1 so that the log cannot move sideways or rotate. This firm gripping action produces true and straight saw lines as the log moves through the saws. This is the situation illustrated in FIG. 3.

As previously mentioned, each chain A and B has three dogs equally spaced so that the operator does not have to wait for a dog to reach a desired operating position, thereby avoiding waste of time.

Figure 13:
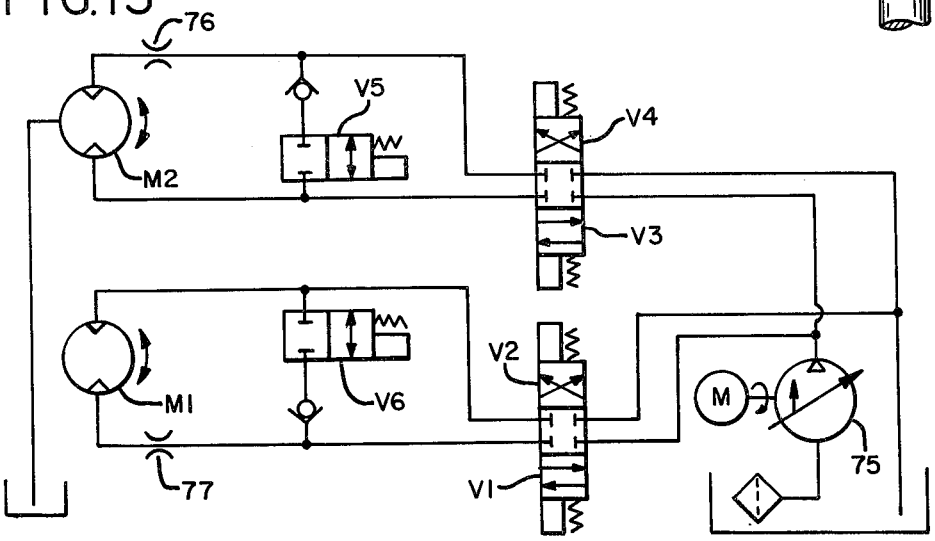
FIG. 13 is a schematic diagram of the hydraulic system for the drive motors.
Figure 14:
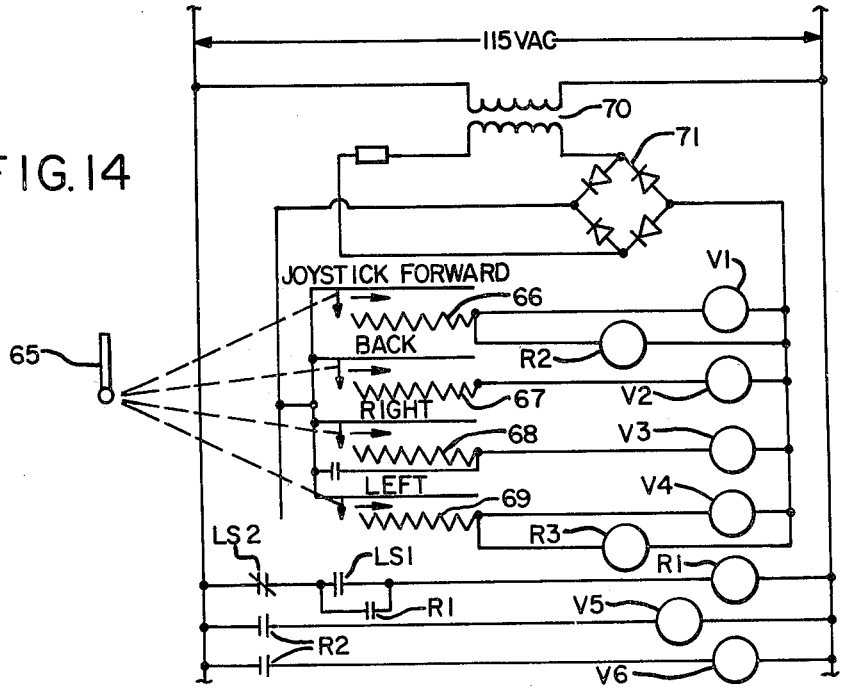
FIG. 14 is a diagram of the electrical control system.

The operations illustrated in FIGS. 3–6 will be described with reference to the hydraulic and electrical control systems in FIGS. 13 and 14. The operator controls the directions and speeds of the chains A and B by manipulation of the joystick 65 in FIG. 14. This joystick controls four variable resistors 66–69 which control the voltage supplied to the coils of the four solenoid valves V1, V2, V3 and V4. Valve V1 controls the forward speed of push chain A and V2 controls the speed in reverse. Valve V3 controls the forward speed of holdback chain B and V4 controls the speed in reverse. Valve V5 is a bypass valve controlling holdback chain B and V6 is a bypass valve controlling push chain A.

Relay R1 operates to move the holdback chain dog to the start position for a sawing operation (dog H1 in FIG. 3) and relay R2 opens the bypass valve on holdback chain B. Relay R3 opens the bypass valve on push chain A. Limit switch LS1 operates relay R1 and limit switch LS2 holds relay R1 closed until the holdback dog arrives at start position.

These controls are energized from a twelve volt DC system through transformer 70 and bridge rectifier 71. The solenoid coils in the directional valves V1, V2, V3 and V4 respond to the voltage controlled by joystick resistors 66–69 causing the valves to open wider with an increase in voltage to make the chains run faster. The valves control a source of hydraulic energy produced by the motor driven pump 75 which drives the previously mentioned hydraulic motor M1 for chain A and M2 for chain B, in FIG. 13.

When the log L1 has been placed on track frame 10 in position for sawing just behind holdback dog H1, the operator moves joystick 65 forward to supply a voltage to the solenoid of valve V1 causing push chain A to move forward until push dog P1 reaches the end of the log. This starts the log moving toward the saws bringing the leading end of the log into contact with holdback dog H1 before the log enters the saws, as shown in FIG. 3.

The movement of the log pushes dog H1 on chain B and causes holdback motor M2 to start to turn as a pump to circulate oil in its hydraulic circuit. An adjustable restriction 76 in the hydraulic circuit (FIG. 13) imposes a small amount of back pressure on the motor M2 so that the dog H1 will firmly grip the log.

As the operator moves the joystick 65 farther forward, the log moves faster because a higher voltage is applied to the solenoid of valve V1. As the log moves out of the saws and the operator wants it to move still faster, he continues to push the joystick farther forward. At this point the holdback chain B is applying an excessive holdback force against the log which limits the desirable terminal speed.

When this condition occurs, the increased voltage applied to relay R2 opens valve V5 to bypass the hydraulic fluid circulating through hydraulic motor M2 to reduce the hold-back resistance against the log. Restrictor 76 and the weight of the log on the chain and track frame then produce enough resistance so that the log can be stopped at any place as long as the teeth on both dogs H1 and P1 are engaged in the log; they will hold the log indefinitely.

Figure 5:
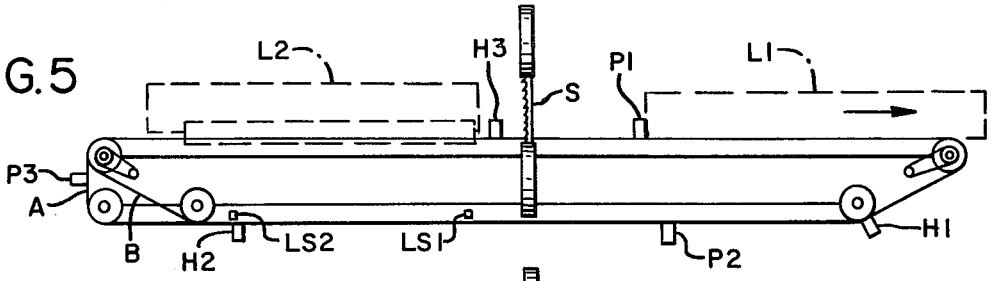

At the point where holdback dog H1 is about to leave the forward end of the log and turn around sprocket wheel 42 (FIG. 4), dog H2 actuates limits switch LS1 to close relay R1. This relay then applies the full twelve volts to the solenoid of valve V3 causing holdback chain B to run fast, pulling dog H1 away from the leading end of the log until dog H2 actuates limit switch LS2 (FIG. 5). This de-energizes relay R1 and leaves the next holdback dog H3 in front of the saws to receive the next log, L2 (FIG. 5).

Figure 6:
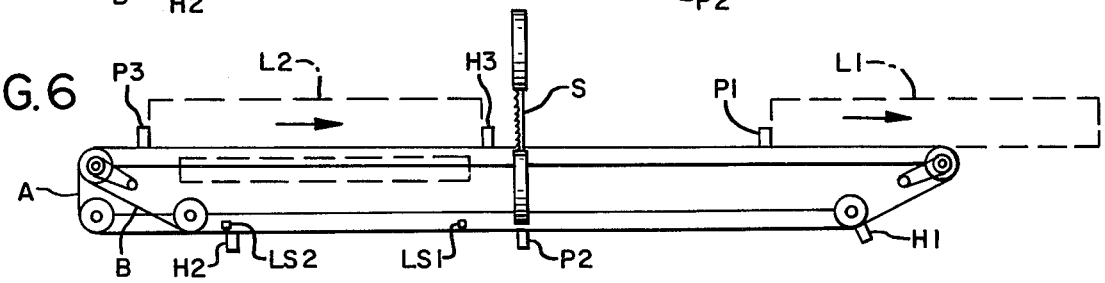

As holdback dog H1 leaves the log in FIG. 5 the log enters the power driven pull-out rolls 80 in FIG. 1 and they pull the log away from the push dog P1 clearing the way for the next log. This action is also is illustrated in FIG. 7. The sawed off slabs or boards are discharged laterally by screw type offbearing rolls 81 in FIG. 1. In FIG. 6 the next log L2 is gripped between the dogs H3 and P3 in the same position as log L1 in FIG. 3, ready for sawing.

If the operator wishes to reverse the log, the holdback chain B is used as a push chain. By moving the joystick 65 to the left the operator applies a voltage to valve V4 and the log will reverse using the push chain A and one of its dogs to hold the log back. In this movement adjustable restrictor 77 retards the motor M1, while operating as a pump, in the same manner that restrictor 76 operates on motor M2 in forward movement, as described above.

As observed in FIG. 2, this apparatus provides completely free and unobstructed space above the logs without imposing any restriction on the diameter of the logs and requiring no adjustment for logs of different diameters.

What is claimed is:

1. In a sawmill apparatus having means to move a log lengthwise in a horizontal path through a pair of vertical saws to cut slabs off opposite sides of the log, said means comprising a single horizontal track frame having an upper side extending between said saws beneath said path of the log, a pair of guideways in side by side relation in said upper side of said track frame, a first endless chain having an upper reach disposed for travel in one of said guideways, an upstanding dog on said first chain to engage one end of the log, a second endless chain disposed for travel in the other of said guideways, an upstanding dog on said second chain to engage the opposite end of the log, and means to drive said chains, the space above said track frame being free of any obstruction that would limit the diameter of logs sawed by said saws, said track frame comprising a group of vertical plates secured together in face to face relation, said plates comprising a median plate, a pair of outside plates, and a spacer plate between said median plate and each outside plate, the spaces between said median plate and said outside plates defining said pair of guideways, a pair of chain support plates in each of said guideways on opposite sides of said spacer plates, each chain having outside links riding on the top edges of said chain support plates and having median links extending downward between said chain support plates, said outside plates serving as skid plates for the log, said outside plates being interrupted between said saws to reduce the width of said track frame between the saws, said dogs being links in said chains, the log engaging faces of said dogs being inclined away from the confronting log ends at a small angle.

2. Apparatus as defined in claim 1, said dogs being laterally offset to travel in a common vertical plane between said guideways.

3. Apparatus as defined in claim 1 one of said dogs being a push dog and the other being a holdback dog, a first drive shaft having sprocket wheels for said chains at the trailing end of said track frame, the sprocket wheel for the push dog chain being keyed to said shaft to drive the push dog chain and the sprocket wheel for the holdback dog chain being mounted for rotation on said shaft; a second drive shaft having sprocket wheels for said chains at the leading end of said track frame, the sprocket wheel for the holdback dog chain being keyed to said second shaft and the sprocket wheel for the push dog chain being mounted for rotation on said second shaft.

4. Apparatus as defined in claim 3, one of said drive shafts being adjustable to tighten or loosen both of said chains, and a third shaft having sprocket wheel for one of said chains, said third shaft being adjustable to tighten or loosen said one chain independently of the other chain.

5. Apparatus as defined in claim 3 including a first variable speed, reversible motor driving said first drive shaft, a second variable speed, reversible motor driving said second drive shaft, and a joystick control lever having fore-and-aft motion to control the direction of rotation and speed of one of said motors and having side-to side motion to control the direction of rotation and speed of the other motor.

6. Apparatus as defined in claim 5, said motors being hydraulic motors, solenoid valves controlling a hydraulic fluid pressure supply for said motors, and variable resistors controlled by said motions of said joystick to control the degree of opening of said valves for controlling the speeds of said motors.

* * * * *